US008344881B1

(12) United States Patent
Hays

(10) Patent No.: US 8,344,881 B1
(45) Date of Patent: Jan. 1, 2013

(54) SYSTEM AND METHOD FOR CASCADED TAMPER DETECTION

(75) Inventor: Lyman Vinton Hays, Westlake Village, CA (US)

(73) Assignee: Exelis, Inc., McLean, VA (US)

( * ) Notice: Subject to any disclaimer, the term of this patent is extended or adjusted under 35 U.S.C. 154(b) by 465 days.

(21) Appl. No.: 12/626,083

(22) Filed: Nov. 25, 2009

(51) Int. Cl.
*G08B 13/00* (2006.01)

(52) U.S. Cl. ..... 340/540; 340/541

(58) Field of Classification Search ..... 340/539.31, 340/856.3, 555, 552, 508, 507, 540, 541
See application file for complete search history.

(56) References Cited

U.S. PATENT DOCUMENTS 3,733,602 A * 5/1973 Cuckler et al. ..... 342/27
4,622,541 A * 11/1986 Stockdale ..... 340/566
5,552,767 A * 9/1996 Toman ..... 340/540
5,739,754 A 4/1998 Schrott et al.
5,910,774 A * 6/1999 Capriotti et al. ..... 340/637
6,879,257 B2 * 4/2005 Hisano et al. ..... 340/568.2
6,954,145 B2 * 10/2005 Nakamura et al. ..... 340/553
7,015,823 B1 * 3/2006 Gillen et al. ..... 340/652
7,495,555 B2 * 2/2009 Seal et al. ..... 340/551
7,760,109 B2 * 7/2010 Broad et al. ..... 340/539.23
7,961,088 B2 * 6/2011 Watts et al. ..... 340/506

* cited by examiner

*Primary Examiner* — Daniel Wu
*Assistant Examiner* — Mohamed Barakat
(74) *Attorney, Agent, or Firm* — RatnerPrestia

(57) ABSTRACT

A system for providing tamper detection includes a plurality of circuit cards in a housing. The housing includes magnetic sensors and magnetic signal generators that form multiple pairs of a magnetic sensor (S) coupled to a magnetic signal generator (M). Each pair of S and M forms a tamper detector for a respective circuit card in the housing. A tamper detector of one circuit card notifies another tamper detector of another circuit card of the occurrence of a tamper event. As an example, a first tamper detector of a first circuit card notifies a second circuit card of the occurrence of a tamper event, and a second tamper detector of the second circuit card notifies a third circuit card of the occurrence of the tamper event. The first tamper detector is configured to sense a change in a magnetic field surrounding the first circuit card and generate a magnetic pulse for transmission to the second circuit card. The second tamper detector is configured to sense a change in a magnetic field surrounding the second circuit card and generate a magnetic pulse for transmission to the third circuit card.

19 Claims, 6 Drawing Sheets

SYSTEM AND METHOD FOR CASCADED TAMPER DETECTION

FIELD OF THE INVENTION

The present invention relates, in general, to a system and method for wirelessly detecting any tampering of an object by an intruder. More specifically, the present invention relates to wirelessly detecting a displacement of an object in a set of objects and communicating that displacement to the other objects in the set.

BACKGROUND OF THE INVENTION

Unauthorized tampering into the inside of a package, such as intrusion into a housing having multiple circuit cards, or intrusion into a container having a protected volume of items is an ever present problem. Various measures are taken to prevent, or detect such intrusion and provide an external alarm of the intrusion, or undertake other protective actions. Anti-tamper devices, including the deliberate destruction of a device when a tamper has been detected, are known in field of tamper identification.

As an example, a door of a house may include a sensor for detecting motion and activating an alarm when motion of the door is detected. Another example may be a wiring mesh that is placed in a top layer of a multiple layered circuit card. When the wiring mesh is cut, because someone is cutting into the layers of the circuit card in an attempt to reverse engineer the circuit card, a voltage may be interrupted in the wiring mesh which may activate a current to destroy any logic in the circuit card.

Another example is disclosed in U.S. Pat. No. 7,495,555, issued Feb. 24, 2009, which includes a method for detecting and reporting magnetic fields in the proximity of a utility meter in order to report tampering of such a meter. Utility meters may be adversely affected by spurious electromagnetic energy placed adjacent to a utility meter. If such energy is strong enough, the energy may reduce or eliminate altogether the meter's ability to measure the consumed energy. In order to combat this problem, several magnetic sensors may be placed inside a utility meter, where each sensor may have a different threshold setting. If a magnetic field is applied externally to the utility meter by a customer and the field is strong enough, a combination of the sensors may detect the external electromagnetic energy. The event may be reported by each magnetic sensor to a centralized computer which, in turn, may report the event to a transmitter residing within the utility meter for remote communication.

The present invention, as will be explained, detects tampering into a container, such as a housing of circuit cards, but does not use a central point, such as a computer, to collect the report of the tampering event from each independent sensor. Instead, the present invention propagates the tampering event to other sensors that are positioned in spatial sequence to the initial sensor that detected the tampering event. In this fashion, each of the sensors is alerted of the tampering event in a cascade manner, or in a sequential manner. In addition, the present invention advantageously reports the tampering event from one sensor to an adjacent sensor without need of physical connections between one sensor and an adjacent sensor.

SUMMARY OF THE INVENTION

To meet this and other needs, and in view of its purposes, the present invention includes a system for providing cascaded tamper detection. One embodiment includes a plurality of items in a housing, with a plurality of sensors (Ss) and a plurality of signal generators (Ms) arranged in alternating sequence of S, M, S, M, etc. Each adjacent S and M forms a tamper detector for a respective item in the housing. A tamper detector of one item notifies another tamper detector of another item of a tamper event occurrence. A first adjacent S and M forms a first tamper detector of a first item in the housing; and a second adjacent S and M forms a second tamper detector of a second item in the housing. The first tamper detector is configured to sense a change in an electromagnetic field and generate a first electromagnetic signal to the second tamper detector. The second tamper detector is configured to sense another change in an electromagnetic field based on the first electromagnetic signal generated by the first tamper detector. The second tamper detector is configured to generate a second electromagnetic signal to a third item in the housing. The first electromagnetic signal is transmitted wirelessly to the second tamper detector. The items in the housing are circuit cards. Each circuit card includes at least one S and M to form a respective tamper detector.

Each circuit card includes two pairs of S and M. One pair of S and M is configured to detect a tamper event based on an electromagnetic signal arriving from one direction. The other pair of S and M is configured to detect another tamper event based on another electromagnetic signal arriving from another direction.

The items in the housing may be secured containers placed within different locations of the housing. Each secured container may include at least one S and M to form a respective tamper detector. Each S may include a magnetic sensor for sensing a change in a quiescent magnetic field. Each M may include a magnetic generator for providing a magnetic pulse as a notification of the tamper event occurrence. Each S may include a memory for storing the quiescent magnetic field. A comparator may be included for comparing the quiescent magnetic field stored in the memory with a magnetic field generated by displacement of an item in the housing. Each M may include an electromagnet for generating the magnetic pulse. Each pair of S and M may be coupled by a control signal provided from a respective S to a respective M.

Another embodiment of the present invention is a system for providing tamper detection comprising a plurality of circuit cards in a housing; and a plurality of magnetic sensors and a plurality of magnetic signal generators forming multiple pairs of a magnetic sensor (S) coupled to a magnetic signal generator (M). Each pair of S and M forms a tamper detector for a respective circuit card in the housing. A tamper detector of one circuit card notifies another tamper detector of another circuit card of an occurrence of a tamper event.

A second circuit card may be sandwiched between a first circuit card and a third circuit card. A first tamper detector for the first circuit card may notify the second circuit card of the occurrence of the tamper event. The second tamper detector for the second circuit card may notify the third circuit card of the occurrence of the same tamper event.

The first tamper detector may be configured to sense a change in a magnetic field surrounding the first circuit card and may generate a magnetic pulse for transmission to the second circuit card. The second tamper detector may be configured to sense a change in a magnetic field surrounding the second circuit card and may generate a magnetic pulse for transmission to the third circuit card.

The change in the magnetic field surrounding the first circuit card may be based on displacement of the first circuit card in the housing. The change in the magnetic field surrounding the second circuit card may be based on the magnetic pulse transmitted by the first tamper detector. The change in the magnetic field surrounding the third circuit card may be based on the magnetic pulse transmitted by the second tamper detector.

Each pair of S and M may include a magnetic sensor for sensing a change in a quiescent magnetic field surrounding the respective circuit card; and a magnetic generator for providing a magnetic pulse as a notification of the tamper event occurrence of the respective circuit card. An S may include a memory for storing the quiescent magnetic field, and a comparator for comparing the quiescent magnetic field stored in the memory with a magnetic field generated by either a displacement of the respective circuit card, or a receipt of a respective magnetic pulse generated by an adjacent circuit card.

Yet another embodiment of the present invention includes a system for providing tamper detection comprising:

a plurality of items in a network, a first sensor for sensing a first tamper event in a first item in the network, a first signal generator for radiating a first alert, in response to the first tamper event, and a second sensor, in a second item in the network, for sensing a second tamper event, in response to receiving radiation of the first alert from the first signal generator.

The second sensor may be configured to sense the second tamper event, in response to an electrical line, connected to the second sensor, providing an alert signal from another item in the network. The system may also include a third sensor for sensing a third tamper event in a third item in the network. Another signal generator may radiate another alert, in response to the third tamper event. The third sensor may be configured to sense radiation received from (a) another radiating alert provided by another item in the network, or (b) a direct line providing another alert signal from another item in the network.

Still another embodiment of the present invention is a method of reporting a tamper event in a housing. The method includes the steps of:

detecting a first change in a quiescent field surrounding a first item in the housing;

transmitting a first pulse to a second item in the housing, after detecting the first change surrounding the first item;

detecting a second change in another quiescent field surrounding the second item in the housing, after receiving the first pulse by the second item; and transmitting a second pulse to a third item in the housing, after detecting the second change surrounding the second item.

Detecting a change may include detecting a change in a magnetic field, and transmitting a pulse may include transmitting a magnetic pulse. Detecting a change may include detecting a change in one or a combination of a magnetic field, an electric field, light energy, sound energy, vibration energy, and heat energy. Transmitting a pulse may include transmitting one or a combination of a magnetic pulse, an electric pulse, a light pulse, a sound pulse, a vibration pulse, or a heat pulse.

The first, second and third items may be first, second and third circuit cards, respectively.

It is understood that the foregoing general description and the following detailed description are exemplary, but are not restrictive of the invention.

BRIEF DESCRIPTION OF THE FIGURES

The invention may be understood from the following detailed description when read in connection with the accompanying figures.

DETAILED DESCRIPTION OF THE INVENTION

As will be explained, the present invention includes a system and method for wirelessly detecting tampering of an object by an intruder. More specifically, the present invention relates to wirelessly detecting a displacement of an object in a set of objects and communicating the fact of that displacement to the other objects in the set. In addition, the present invention communicates the fact of displacement of the object in a cascade, or in a spatially sequential manner. Advantageously, the wireless nature of the system makes it difficult for an intruder to defeat the system.

Figure 1:
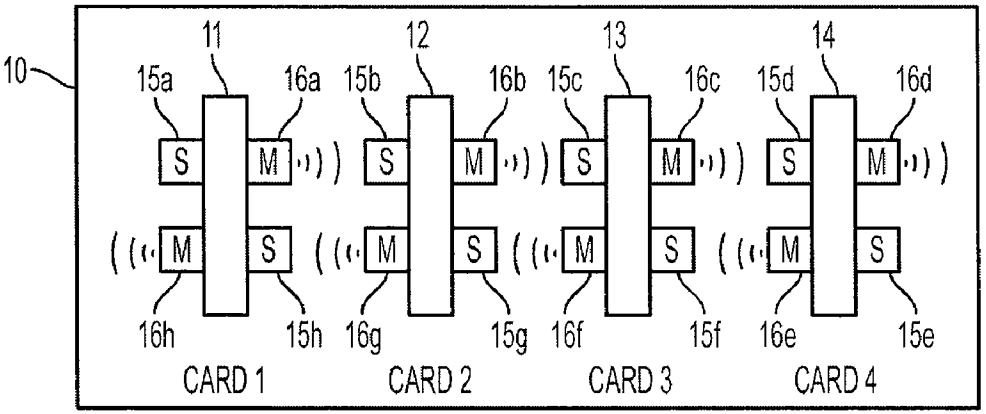
FIG. 1 is a functional schematic diagram of a housing containing multiple circuit cards, including an embodiment of the present invention.

Referring to FIG. 1, there is shown an embodiment of the present invention. As shown, housing 10 includes several circuit cards, only four of which are shown designated as 11, 12, 13 and 14, respectively. Each circuit card includes at least one pair of magnetic sensor (also referred to as S) 15 and magnetic generator (also referred to as M) 16. As shown, however, each circuit card includes two pairs of S 15 and M 16, disposed adjacent to the edges of the circuit card, with each pair of S and M disposed on opposite sides of the circuit card. In addition, the magnetic generator 16 of card 1, for example, is located facing the magnetic sensor 15 of card 2. Similarly, each card includes magnetic sensor 15 facing magnetic generator 16 of an adjacent card.

Still referring to FIG. 1, while one edge of each card includes an S and M pair ordered spatially from left to right, the other edge of the same card includes another S and M pair ordered spatially from right to left. Each circuit card may thus be similarly manufactured with two S and M pairs. As will be explained, however, the first circuit card and the last circuit card in housing 10 need only have one S and M pair on the same side of the circuit card. Thus, as an example, circuit card 11 on the left side of housing 10, need not have the S and M pair designated as 15*a* and 16*h*, while circuit card 14 on the right side of housing 10, need not have the S and M pair designated as 15*e* and 16*d*.

As shown, positioned from left to right, at one edge of the cards in housing 10, are the following sets of pairs, each pair comprising a tamper event detector: a pair of sensor 15*a* and magnetic generator 16*a*; another pair of sensor 15*b* and magnetic generator 16*b*; yet another pair of sensor 15*c* and magnetic generator 16*c*; and still another pair of sensor 15*d* and magnetic generator 16*d*. The placement sequence of these multiple tamper event detectors in housing 10 allows the present invention to send a cascading alert of a tamper event from any circuit card to another set of circuit cards positioned from left to right in housing 10.

Positioned from right to left, at the other edge of the cards in housing 10 are the following sets of pairs, each pair comprising a tamper event detector: a pair of sensor 15*e* and magnetic generator 16*e*; another pair of sensor 15*f* and magnetic generator 16*f*; yet another pair of sensor 15*g* and magnetic generator 16*g*; and still another pair of sensor 15*h* and magnetic generator 16*h*. The placement sequence of these multiple tamper event detectors in housing 10 allows the present invention to send a cascading alert of a tamper event from any circuit card to another set of circuit cards positioned from right to left in housing 10.

Figure 2:
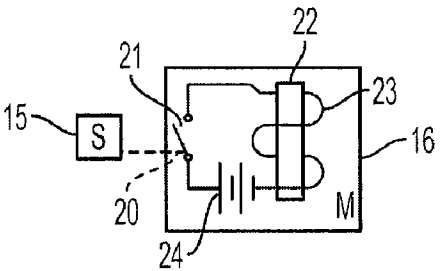
FIG. 2 is a functional schematic diagram depicting the interaction between a magnetic sensor (S) and a magnetic change generator (M), used in the housing shown in FIG. 1, in accordance with an embodiment of the present invention.

An exemplary tamper event detector of the present invention is shown in FIG. 2. Sensor (S) 15 may be placed on one side of a circuit card in housing 10 and generator (M) 16 may be placed on the other side of the same circuit card. The sensor 15 may be any type of sensor, such as a magnetic sensor, a light sensor, an electric sensor, a heat sensor, a sound sensor, a vibration sensor, etc. The generator 16 may correspondingly be an alert transmitter for transmitting detection of the event sensed by a respective sensor 15. The generator 16 of the present invention is effective in transmitting the detected event to another sensor 15 disposed on an adjacent circuit card.

For example, a tamper event may be sensed by magnetic sensor 15*b* of circuit card 12. The tamper event, in turn, is sent to magnetic generator 16*b*. Next, magnetic generator 16*b* transmits a magnetic pulse to magnetic sensor 15*c* of circuit card 13. Continuing in a cascade sequence, magnetic sensor 15*c* detects the tamper event and sends notification of the same event to magnetic generator 16*c* of circuit card 13. Magnetic generator 16*c* then alerts magnetic sensor 15*d* of circuit card 14.

In the embodiment shown in FIG. 2, sensor 15 is a magnetic sensor. For example, the sensor may include a pickup coil and a soft magnetic material as the core of the pickup coil. Because of the core's large permeability, typically several thousand times as large as that of air, the magnetic sensor is effective in picking up any change in the quiescent, or steady state magnetic flux surrounding magnetic sensor 15. The sensing of this flux results in a voltage produced on control line 20, which closes switch 21. The closing of switch 21 causes a current to flow from battery 24 to pickup coil 23. Since the coil is wound around magnetic core 22, an instantaneous flux is produced by core 22 which is transmitted outwardly from magnetic generator 16. The instantaneous flux may be represented by a magnetic pulse that is formed for a short duration, but is sufficiently strong to be picked up by another magnetic sensor 15 located on an adjacent circuit card. Examples of solid state magnetic sensors include Hall effect and magneto-resistive devices.

It will be understood that the flux produced by magnetic generator 16 may be oriented along a spatial line which provides a clear magnetic path to the adjacent magnetic sensor of another circuit card. In this manner, the magnetic pulse produced by magnetic generator 16 of one circuit card is effective in transmitting the tamper event to the magnetic sensor of the adjacent circuit card.

Figure 3:
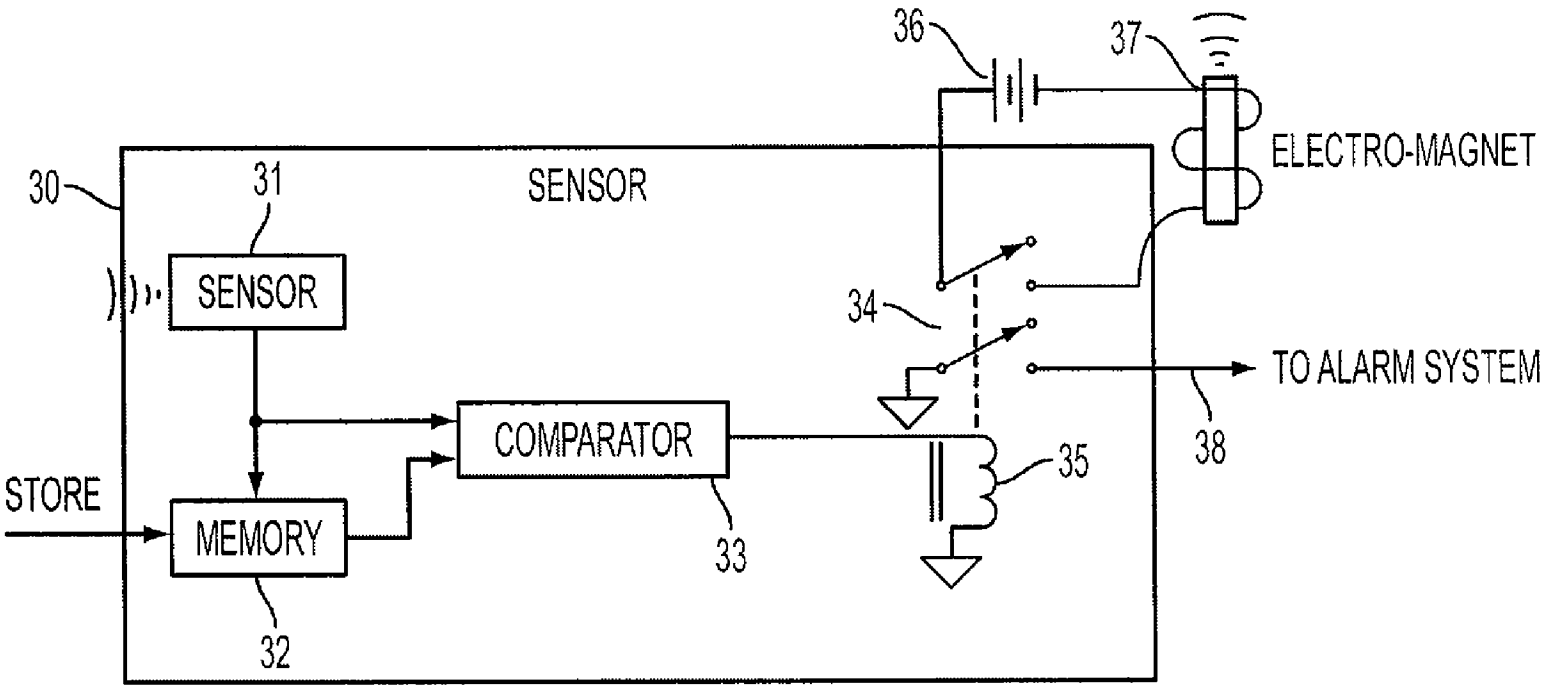
FIG. 3 is a schematic circuit depicting a magnetic sensor, in accordance with an embodiment of the present invention.

Referring next to FIG. 3, there is shown an exemplary embodiment of the present invention for a magnetic sensor, generally designated as 30. As shown, magnetic sensor 30 includes magnetic sensor 31, memory storage 32, comparator 33 and a relay formed by coil 35 and switch 34. The switch 34 includes a double pole, single throw switch for providing notification of a tamper event to a magnetic generator formed by a circuit including battery 36 and electromagnet 37. The switch 34 also includes an output for providing an alert of the tamper event by way of control line 38 to a local device that may act to destroy protected information or hardware. The output may also be provided to a remote alarm system.

In operation, sensor 31 produces a voltage output that is proportional to the quiescent magnetic field surrounding magnetic sensor 30. A store command to memory 32 loads the voltage output produced by the quiescent magnetic field into the memory. The comparator 33 continuously or intermittently compares the stored voltage with the instantaneously produced voltage output from magnetic sensor 30. If the sensed magnetic field differs from the quiescent stored field by a predetermined amount, comparator 33 provides a voltage output to energize coil 35. The energizing of coil 35 activates switch 34 which, in turn, produces a current from battery 36 into electromagnet 37. The electromagnetic radiates a pulse of magnetic energy outwardly toward an adjacent magnetic sensor 30. This results in the wireless notification of a tamper event to nearby assemblies or circuit cards in an integral housing or container.

In operation, for example, sensor 31 of FIG. 3, or sensor 15 of FIG. 1 senses a magnetic field change surrounding the volume of space in the proximity of an item, for example, circuit card 11 of FIG. 1. The magnetic field change may be due to a displacement of circuit card 11 by an intruder, or may be due to an attempt to defeat operation of a magnetic sensor or a magnetic generator. The magnetic field change detected by the magnetic sensor 15*a* is provided to magnetic generator 16*a*, which outputs a short pulse to an adjacent item, such as adjacent circuit card 12. The magnetic sensor 15*b* of circuit card 12 detects the magnetic pulse and notifies magnetic generator 16*b*. In sequence, magnetic generator 16*b* communicates with magnetic sensor 15*c* of circuit card 13. The magnetic generator 16*c* is notified to produce another short pulse for communication to the next adjacent circuit card 14. This process is repeated in cascade, until all the other circuit cards in housing 10 are notified of the tamper event.

The description of system 10 shows an arrangement of sensors and generators in which wireless signals are propagated in one direction. In the example shown in FIG. 1, the propagation is described as cascading in a clockwise direction. It will be understood, however, that the present invention also contemplates an arrangement of sensors and generators in a system in which signals may propagate in more than one direction. Accordingly, the sensors and generators may be arranged so that one sensor may alert two or more additional sensors, and each of the additional sensors may cause a wireless signal propagation in a different direction. One example of such a system is described below with reference to FIGS. 6 and 7.

If desired, magnetic sensor 15 may be configured similarly to magnetic sensor 30. As described above, magnetic sensor 30 may be configured to provide a wired alert to a remote alarm system.

If desired, upon communication of the tamper event to the circuit cards in housing 10, provisions may be included to erase sensitive programs, or erase protected information residing in each circuit card. In addition, provisions may be included to destroy proprietary hardware elements disposed on each circuit card.

Figure 4:
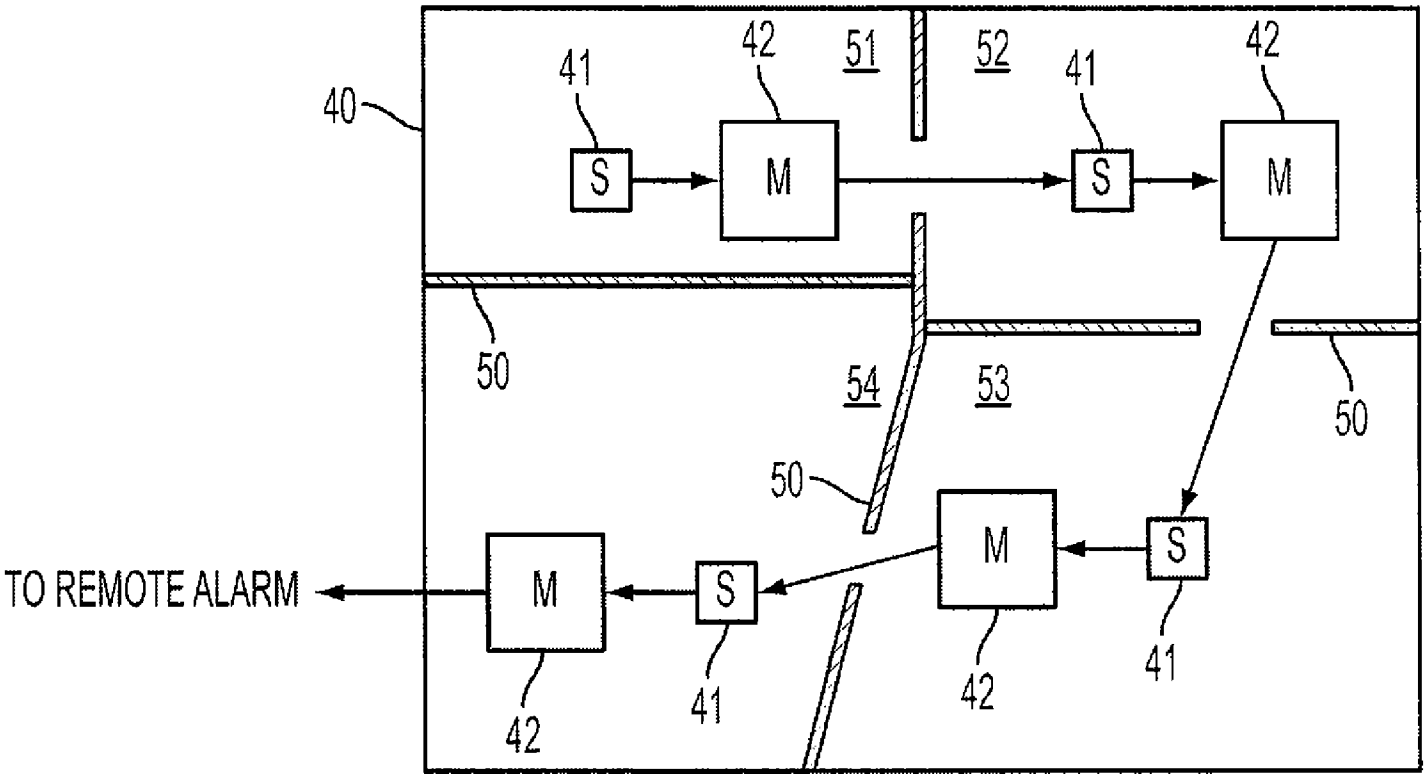
FIG. 4 is a functional diagram of a container including partitioned volumes of space, where each partitioned space has a magnetic sensor and a magnetic change generator, in accordance with an embodiment of the present invention.

Referring to FIG. 4, there is shown another embodiment of the present invention. As shown, a cut-away view of container 40 includes multiple protected spaces 51, 52, 53 and 54.

These protected spaces, which are divided by partitions 50, may include multiple items that are desired by the owner to be protected from unauthorized intrusion. Each protected space has a tamper event detector, including magnetic sensor 41 and magnetic generator 42, which may be placed on a cover (not shown) configured to provide a magnetic energy change when the cover is displaced. Accordingly, if an intruder attempts to get into protected volume 51, the intruder must move the cover on the top space of protected volume 51. Such movement would result in magnetic sensor 41 detecting a magnetic field change, thereby causing magnetic generator 42 to transmit a short pulse outwardly from protected volume 51.

As shown in FIG. 4, magnetic generator 42 may produce a magnetic flux which effectively radiates through an opening in partition 50, so that the flux may be sensed by magnetic sensor 41 disposed on another cover (not shown) of protected volume 52. As described above, a displacement of one cover of protected volume 51 propagates, in cascade, to the other event detectors in container 40. After the protected volumes are notified of the tamper event, protective measures may be taken by the owner to destroy respective items in the container. It will be appreciated that although an opening is shown in divider 50 between one volume and an adjacent volume, nevertheless, a physical opening is not necessary, so long as the magnetic flux may radiate between the protected volumes.

It will be understood that while FIG. 4 shows alert signals propagating in only one direction, the present invention is not limited so. As the example described below with respect to FIGS. 6 and 7 indicates, the present invention may propagate alert signals in more than one direction.

The present invention provides simple means to wirelessly notify each item in a collection of items that a tamper event has occurred. The sensors and the magnetic generators may themselves be enclosed in protected volumes. Power consumption is low, because only the sensor needs to be powered-on full time, while the magnetic generator requires only a single short pulse of power.

Figure 5:
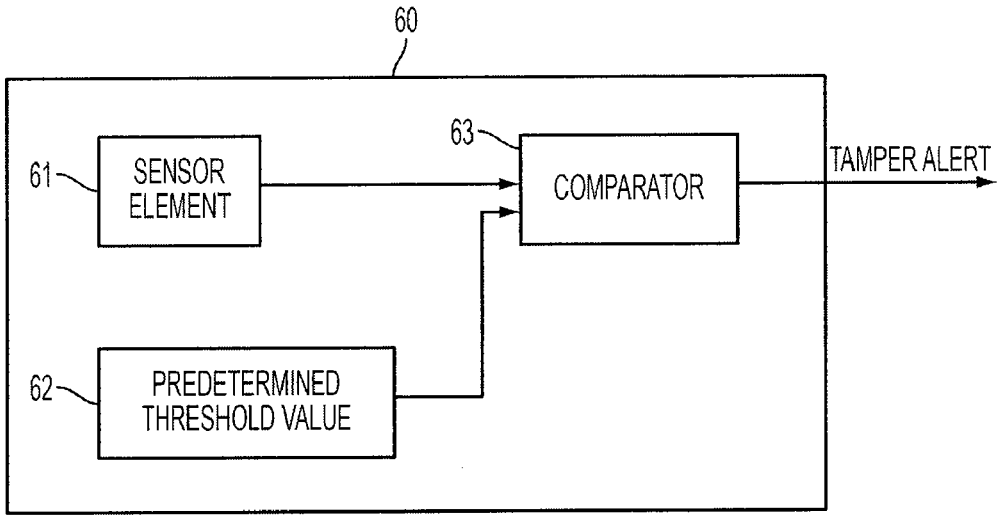
FIG. 5 is a schematic circuit depicting another magnetic sensor, in accordance with another embodiment of the present invention.

FIG. 5 illustrates another exemplary tamper event detector of the present invention. As shown, tamper event detector 60 includes sensor element 61, a predetermined threshold value setting module, designated as 62, and comparator 63. The comparator 63 provides a tamper alert, as an output, to other sensors or generators, when an output from sensor element 61 differs from the threshold value setting of module 62. In this embodiment, the comparison threshold value is predetermined. Thus the embodiment of FIG. 5 is different from the embodiment shown in FIG. 3 with the elimination of memory 32 included in sensor 30.

Figure 6:
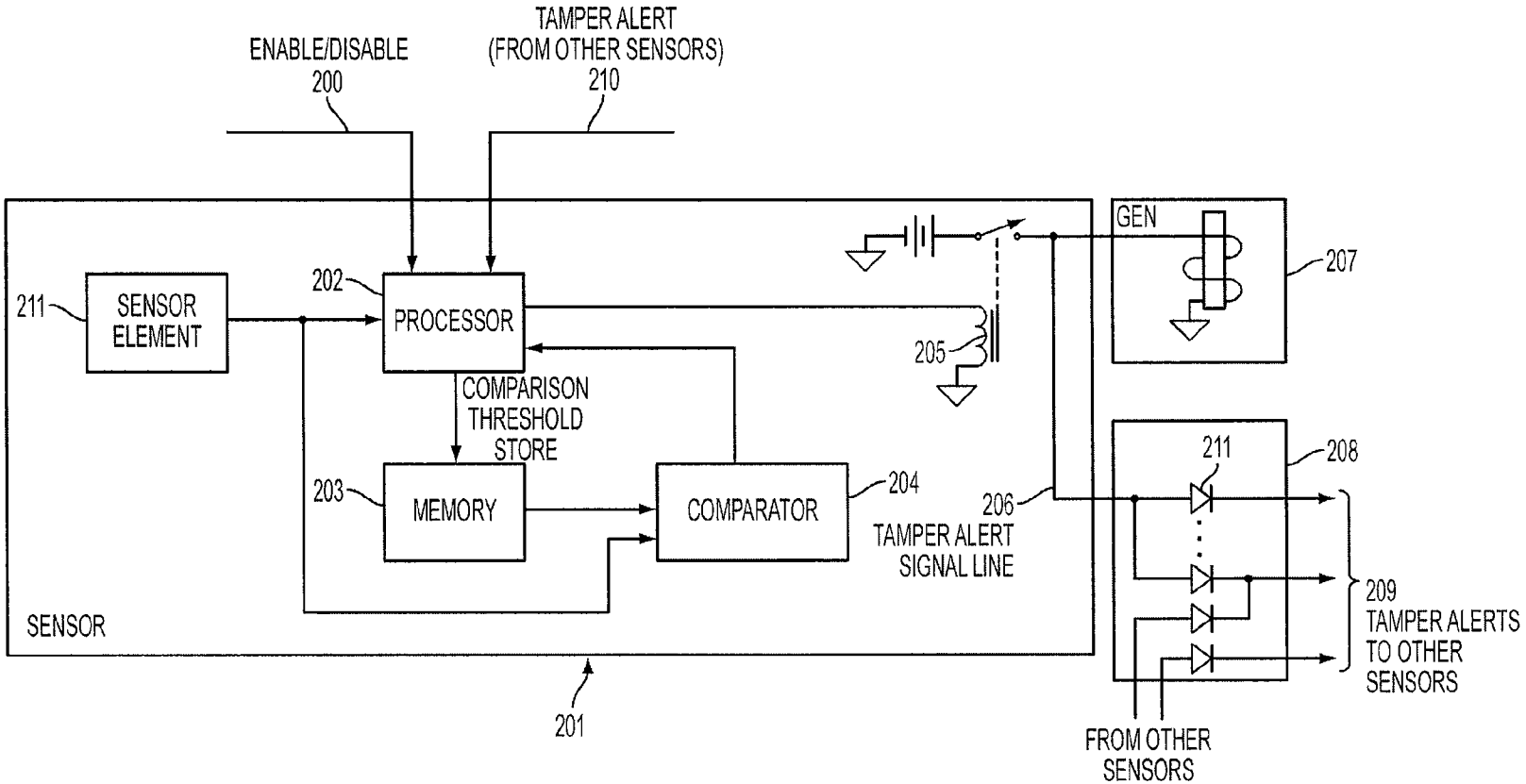
FIG. 6 is a block diagram of a magnetic sensor in communication with other magnetic sensors and other generators, in accordance with another embodiment of the present invention.

FIG. 6 illustrates yet another exemplary tamper event detector of the present invention. Tamper event sensor 201 is coupled to generator 207 and an alert interconnection module, designated as 208. This embodiment includes provisions for outputting tamper alerts to other tamper event sensors or generators, and provisions for inputting tamper alerts from other tamper event sensors or generators.

As shown in FIG. 6, a signal may be inputted on the enable/disable line 200, or a tamper alert signal may be inputted from other sensors on the tamper alert line 210 for alerting processor 202 to enable or disable operation of tamper event sensor 201. The signals carried by enable/disable line 200 may be encoded, in order to prevent unauthorized use of line 200. The processor 202 may then provide any necessary decoding. The processor 202 may also set a threshold value for storage in memory 203.

If the voltage, or current value outputted by sensor element 211 differs from the stored threshold value by a predetermined amount, comparator 204 is configured to alert processor 202 that a tamper event has occurred. The processor 202 may then activate relay 205 which, in turn, may provide a tamper alert signal on line 206. This tamper alert signal may also energize generator 207. It will be recalled that, as described with respect to FIG. 3, for example, generator 207 may also be activated to output a magnetic flux, which may be detected by other tamper event sensors (not shown).

The tamper alert signal on line 206 may be distributed to other locations via tamper alert interconnection logic 208. The interconnection logic 208 may route the tamper alert signal to other generators, other sensors, or elsewhere, as determined by its logical configuration. It will be appreciated that diodes 211 illustrate one means to provide a logic function (such as an OR function); however, other logic arrangements may be constructed. The processor 202 may also receive a tamper alert signal 210 from other tamper event sensors; receipt of such signal, in turn, may cause processor 202 to activate relay 205, thereby generating its own tamper alert signal.

From the above description, it may be evident that sensors and generators may be interconnected such that a sensor may send commands to a plurality of generators, or receive tamper alert signals from a plurality of sensors. In addition, a sensor may receive alert signals from different sensors and may also provide alerts to other sensors in a network. This may be accomplished by way of dedicated signal lines, or wirelessly by magnetic flux propagation, as shown by the exemplary embodiment of FIG. 6.

Figure 7:
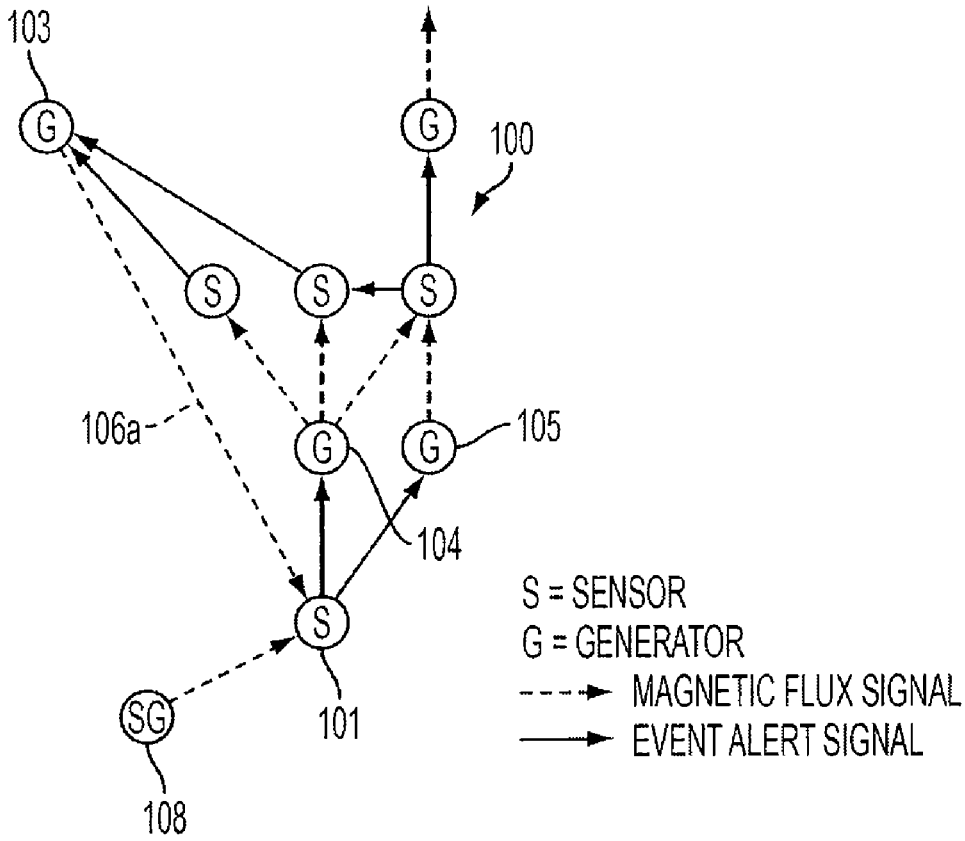
FIG. 7 is a flow diagram of a network communicating among sensors and flux generators and alerting each other of a tamper event(s), in accordance with an embodiment of the present invention.

FIG. 7 illustrates an embodiment whereby sensors S and magnetic generators G are communicating in a network 100. The network 100 has an arbitrary topology that may be one, two or three dimensional. A tamper event detected by any sensor S is communicated to every other sensor S within the network. This is done either via magnetic flux signal 106 (shown as dashed lines) or tamper event alert signal 107 (shown as solid lines), or via a combination of both.

The network 100 may be open or closed loop depending upon its topology. FIG. 7 illustrates a closed loop topology, as magnetic flux signal **106*a* permits transmission of a tamper event alert generated by a sensor S 101 to eventually reach that same sensor S 101**, after traveling counter-clockwise in the network.

A closed loop topology may oscillate. If such oscillation is undesirable, sensors S may be configured to excite their associated magnetic generators G for a limited time period, or for a limited number of tamper event alerts. In FIG. 7 for example, sensor 101 may be configured to pulse magnetic generators 104 and 105 upon either detecting a tamper event or receiving notification of a tamper event from magnetic generator 103. Sensor 101 may then not pulse magnetic generators 104 and 105 again, until such time as a maximum propagation time through the loop has passed. In this manner, oscillation in the network may be prevented.

FIG. 7 includes special generator (SG) 108. The addition of special generator 108 in network 100 provides an ability to advantageously alter the magnetic field in the proximity of one or more sensors S. Such an alteration introduces additional complexity into the magnetic field environment, thereby making it more difficult to defeat operation of network 100. For example, special generator 108, which may be a permanent magnet, provides a steady state magnetic field environment in the proximity of sensor 101. Any alteration of the magnetic field environment by relative motion (or other means) of magnetic generator 103, sensor 101, or special generator 108 would result in sensor 101 detecting a tamper event.

Although illustrated and described herein with reference to specific embodiments, the present invention is nevertheless not intended to be limited to the details shown. Rather, various modifications may be made in the details within the scope and range of equivalents of the claims and without departing from the invention.

What is claimed:

1. A system for providing cascaded tamper detection comprising:

a plurality of items in a housing, in which the housing is a single container, a plurality of sensors (Ss) and a plurality of signal generators (Ms) arranged in alternating sequence of S, M, S, M, and so on, and each adjacent S and M forming a tamper detector of a respective item in the housing, wherein a tamper detector of one item notifies another tamper detector of another item of an occurrence of a tamper event in a cascaded manner;

wherein the S of one tamper detector detects a change in one of a magnetic field, an electric field, light energy, sound energy, vibration energy, and heat energy resulting from displacement of a respective item or a tampering source of field or energy, and notifies another tamper detector by transmitting via the M one of a magnetic pulse, an electric pulse, a light pulse, a sound pulse, a vibration pulse, or a heat pulse respective of the type of field or energy detectable by each S.

2. The system of claim 1 wherein a first adjacent S and M forms a first tamper detector of a first item in the housing, a second adjacent S and M forms a second tamper detector of a second item in the housing, and the first tamper detector is configured to sense a change in an electromagnetic field and generate a first electromagnetic signal to the second tamper detector.

3. The system of claim 2 wherein the first item is adjacent to the second item in the housing, and the second tamper detector is configured to sense another change in an electromagnetic field based on the first electromagnetic signal generated by the first tamper detector, and the second tamper detector is configured to generate a second electromagnetic signal to a third item in the housing.

4. The system of claim 2 wherein the first electromagnetic signal is transmitted wirelessly to the second tamper detector.

5. The system of claim 1 wherein the items in the housing are circuit cards, and each circuit card includes at least one S and M to form a respective tamper detector.

6. The system of claim 5 wherein each circuit card includes two pairs of S and M, wherein one pair of S and M is configured to detect the tamper event based on an electromagnetic signal arriving from one direction, and the other pair of S and M is configured to detect another tamper event based on another electromagnetic signal arriving from another direction.

7. The system of claim 1 wherein the items in the housing are placed within different locations of the housing, and each secured container includes at least one S and M to form a respective tamper detector.

8. The system of claim 1 wherein each S includes a magnetic sensor for sensing a change in a quiescent magnetic field, and each M includes a magnetic generator for providing a magnetic pulse as a notification of the tamper event occurrence.

9. The system of claim 8 wherein each S includes a memory for storing the quiescent magnetic field, and a comparator for comparing the quiescent magnetic field stored in the memory with a magnetic field generated by displacement of an item in the housing.

10. The system of claim 9 wherein each M includes an electromagnet for generating the magnetic pulse, and each pair of S and M is coupled by a control signal provided from a respective S to a respective M.

11. A system for providing tamper detection comprising:

a plurality of circuit cards in a housing, in which the housing is a single container, a plurality of magnetic sensors and a plurality of magnetic signal generators forming multiple pairs of a magnetic sensor (S) coupled to a magnetic signal generator (M), and each pair of S and M forming a tamper detector for a respective circuit card in the housing, wherein a tamper detector of one circuit card notifies another tamper detector of another circuit card of an occurrence of a tamper event in a cascaded manner;

wherein the S of one tamper detector detects a change in a magnetic field resulting from displacement of a respective circuit card or a tampering source of electromagnetic field, and notifies another tamper detector by transmitting via the M a magnetic pulse detectable by each S.

12. The system of claim 11 wherein a second circuit card is sandwiched between a first circuit card and a third circuit card, a first tamper detector for the first circuit card notifies the second circuit card of the occurrence of the tamper event, and the second tamper detector for the second circuit card notifies the third circuit card of the occurrence of the tamper event.

13. The system of claim 12 wherein the first tamper detector is configured to sense a change in a magnetic field surrounding the first circuit card and generate a magnetic pulse for transmission to the second circuit card, and the second tamper detector is configured to sense a change in a magnetic field surrounding the second circuit card and generate a magnetic pulse for transmission to the third circuit card.

14. The system of claim 13 wherein the change in the magnetic field surrounding the first circuit card is based on displacement of the first circuit card in the housing, the change in the magnetic field surrounding the second circuit card is based on the magnetic pulse transmitted by the first tamper detector, and the change in the magnetic field surrounding the third circuit card is based on the magnetic pulse transmitted by the second tamper detector.

15. The system of claim 11 wherein each pair of S and M includes a magnetic sensor for sensing a change in a quiescent magnetic field surrounding the respective circuit card, and a magnetic generator for providing a magnetic pulse as a notification of the tamper event occurrence of the respective circuit card.

16. The system of claim 15 wherein an S includes a memory for storing the quiescent magnetic field, and a comparator for comparing the quiescent magnetic field stored in the memory with a magnetic field generated by either a displacement of the respective circuit card, or a receipt of a respective magnetic pulse generated by an adjacent circuit card.

17. A system for providing tamper detection comprising:

a plurality of items in a housing, in which the housing is a single container, a first sensor (S) for sensing a first tamper event in a first item in the housing, a first signal generator (M) for radiating a first alert, in response to a tamper event, and a second sensor (S), in a second item in the housing, for sensing the tamper event, in response to receiving radiation of the first alert from the first signal generator (M);

wherein any of the tamper detecting sensors (S) detects a change in one of a magnetic field, an electric field, light energy, sound energy, vibration energy, and heat energy resulting from displacement of a respective item or a tampering source of field or energy, and notifies the other of the tamper detecting sensors (S) in a cascaded manner by radiating via the corresponding signal generator (M) one of a magnetic pulse, an electric pulse, a light pulse, a sound pulse, a vibration pulse, or a heat pulse respective of the type of field or energy detectable by each sensor (S).

18. The system of claim 17 including a third sensor for sensing the tamper event in a third item in the housing, and another signal generator for radiating another alert, in response to the tamper event, wherein the third sensor is configured to sense radiation received from (a) another radiating alert provided by another item in the housing, or (b) a direct line providing another alert signal from another item in the housing.

19. The system of claim 17 wherein the first signal generator radiates the first alert and, subsequently, becomes dormant by consuming no primary power.

* * * * *